United States Patent [19]

Garthus et al.

[11] 4,176,013

[45] Nov. 27, 1979

[54] COKE OVEN DOOR SEAL ASSEMBLY

[75] Inventors: Donald R. Garthus, Perrysburg; L. T. Robinson, Swanton, both of Ohio

[73] Assignee: Interlake, Inc., Oak Brook, Ill.

[21] Appl. No.: 871,182

[22] Filed: Jan. 23, 1978

[51] Int. Cl.[2] ..... C10B 25/16

[52] U.S. Cl. ..... 202/242; 49/490; 202/248; 202/269

[58] Field of Search ..... 202/248, 269, 242; 49/490

[56] References Cited

U.S. PATENT DOCUMENTS

| | | | |
|---|---|---|---|
| 3,952,454 | 4/1976 | Sudo | 202/248 X |
| 3,977,125 | 8/1976 | Sudo | 202/248 X |
| 4,032,409 | 6/1977 | Knappstein et al. | 202/248 |

FOREIGN PATENT DOCUMENTS

| | | | |
|---|---|---|---|
| 834689 | 2/1952 | Fed. Rep. of Germany | 202/248 |
| 2357488 | 5/1975 | Fed. Rep. of Germany | 202/248 |
| 694019 | 11/1930 | France | 202/248 |
| 965801 | 9/1950 | France | 202/248 |
| 46-15776 | 4/1971 | Japan | 202/248 |
| 753462 | 7/1956 | United Kingdom | 202/248 |

*Primary Examiner*—Arnold Turk

*Attorney, Agent, or Firm*—Vogel, Dithmar, Stotland, Stratman & Levy

[57] ABSTRACT

Assembly for providing a seal between sealing surfaces on a coke oven door and the associated door jamb includes a high temperature-resistant and resilient seal body extending around the entire periphery of the door and secured between retaining members. A steel bearing strip is disposed beneath the seal body between the retaining members and is engaged at spaced-apart points therealong by a plurality of setscrews threadedly engaged through complementary openings in the door for pushing the bearing strip against the seal body and varying the pressure with which it engages the sealing surface on the door jamb.

7 Claims, 3 Drawing Figures

COKE OVEN DOOR SEAL ASSEMBLY

BACKGROUND OF THE INVENTION AND PRIOR ART STATEMENT

The present invention is an improvement of the door seal disclosed in our copending application Ser. No. 761,666, filed on Jan. 24, 1977, and assigned to the assignee of the present invention. That application discloses a resilient, heat-resistant door seal member mounted on the coke oven door for sealing engagement with an associated sealing surface on the door jamb of the coke oven when the door is in the closed position thereof for providing an improved flexible door seal of simple and economical construction.

While the aforementioned door seal effected significant improvements over prior "self-sealing" doors, it still sometimes failed to provide a perfect gas-tight seal around the coke oven door, by reason of the substantial warpage caused by the extremely high heat encountered in the coke oven. This warpage caused the seal to be uneven at different points around the door periphery.

The French Pat. No. 965,801 discloses a standard metal-to-metal coke oven door seal, wherein one of the metal sealing members is adjustable by means of set-screws. This patent also discloses coating one or both of the metal sealing members with a plastic coating to improve the seal. That patent does not, however, disclose a resilient seal body which is, itself, adjustable.

The French Pat. No. 1,039,912 and the German Pat. No. 863,185 both disclose coke oven door seal assemblies including a resilient seal member mounted on a mounting flange carried by the door. The mounting flange is, in turn, coupled to an adjusting mechanism for deflecting the mounting flange thereby to vary the position of the seal member with respect to the door jamb. The adjusting mechanisms are relatively complex and require a cumbersome mounting apparatus separate from the mounting flange because they must effect a movement of the entire mounting flange.

SUMMARY OF THE INVENTION

The present invention relates to an improved door seal assembly for a coke oven, and in particular to an improved door seal of the resilient or flexible type.

It is a general object of this invention to provide a resilient heat-resistant door seal for a coke oven which is adjustable.

Another object of this invention is to provide a door seal assembly of the type set forth which extends around the entire periphery of a coke oven door and is adjustable at a plurality of spaced-apart points around the door periphery.

Another object of this invention is to provide a simple and economical adjustment means for a resilient door seal member which permits accurate adjustment of the seal member without the necessity of moving or adjusting the associated seal mounting apparatus.

These objects are achieved by providing in a coke oven having a door opening with a first surface extending around the periphery thereof and a door with a second surface extending around the periphery thereof and disposable in a closed configuration for closing the door opening, a door seal assembly comprising two spaced-apart retaining members mounted on one of the first and second surfaces and extending outwardly therefrom and cooperating therewith to define a channel, a resilient heat-resistant seal body fixedly mounted in the channel between the retaining members and extending outwardly therebeyond for sealing engagement with the other of the first and second surfaces around the entire periphery thereof when the door is disposed in the closed configuration thereof, bearing means disposed in the channel between the seal body and the one of the first and second surfaces, and control means adjustably mounted for engagement with the bearing means to urge it into engagement with the seal body with a variable pressure, whereby adjustment of the control means effects a corresponding adjustment of the pressure with which the seal body engages the other one of the first and second surfaces when the door is disposed in the closed configuration thereof.

Further features of the invention pertain to the particular arrangement of the parts of the door seal assembly whereby the above-outlined and additional operating features thereof are attained.

The invention, both as to its organization and method of operation, together with further objects and advantages thereof, will best be understood by reference to the following specification taken in connection with the accompanying drawings.

DESCRIPTION OF THE PREFERRED EMBODIMENT

Figure 1:
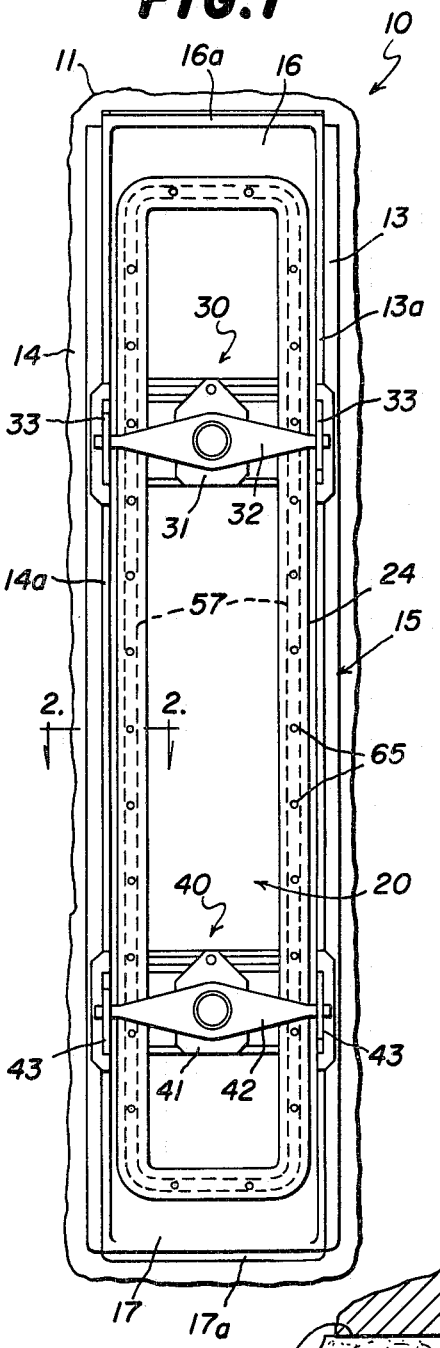
FIG. 1 is a front elevational view of a coke oven door including a door seal assembly constructed in accordance with and embodying the features of the present invention, with the door disposed in the closed position thereof and viewed from the outside thereof.

There is illustrated in the drawings a portion of a coke oven, generally designated by the numeral 10, and in particular a portion of the outer refractory wall 11 thereof around a doorway providing entry into the coke oven chamber. A door frame, generally designated by the numeral 15, surrounds the doorway and includes a pair of vertical door jambs 13 and 14, interconnected at the upper and lower ends thereof respectively by a headsill 16 and a footsill 17. The jambs 13 and 14 and the sills 16 and 17 are respectively provided with outwardly extending flanges **13*a*, 14*a*, 16*a* and 17*a*. Also provided on the door frame 15 and extending around the entire periphery thereof is a flat planar sealing surface 18 (see FIGS. 2 and 3**).

An oven door, generally designated by the numeral 20, is mountable by suitable means (not shown) in a closed position, illustrated in the drawings, closing the oven doorway. The oven door 20 includes a refractory retainer 21 which extends inwardly of the oven doorway when the door is in the closed position thereof, and is adapted for securing in place a wall of refractory brick material (not shown) to provide the main heat-insulating body of the door 20. Fixedly secured to the refractory retainer 21 and spaced therefrom by a gasket 23 is a seal plate 24 which is disposed in use in a substantially vertical plane and extends outwardly beyond the retainer 21 around the entire periphery thereof. Secured to the seal plate 24 and spaced therefrom by a gasket 25 is a mounting plate 26, which is in turn secured to a lining retainer 27 on the outside of the door 20. The seal plate 24 is provided with a plurality of apertures 28 therethrough adjacent to the outer edge thereof, the apertures 28 all being substantially circular and identically dimensioned and being spaced apart a predetermined distance around the entire perimeter of the seal plate 24, for a purpose to be described more fully below.

The oven door 20 is provided adjacent to the upper and lower ends thereof with spring-loaded lock assemblies 30 and 40, which are respectively provided with mounting plates 31 and 41 on which are pivotally mounted latch arms 32 and 42. The latch arms 32 and 42 are mounted for rotational movement into and out of engagement with keepers 33 and 43 carried by the door frame 15, securely to latch the oven door 20 in the closed position thereof.

The coke oven 10, door frame 15 and oven door 20 as described above are of a standard construction, well known in the art.

Mounted on the seal plate 24 and extending substantially around the entire perimeter thereof is a door seal assembly, generally designated by the numeral 50, which includes a pair of spaced-apart parallel retainer bars 51 and 52, each of which is in the form of a flat rectangular steel strip or plate fixedly secured as by welding to the inner surface of the seal plate 24 adjacent to the outer edge thereof and extending therefrom substantially normal thereto. The retainer bars 51 and 52 extend around the entire periphery of the seal plate 24 and may comprise a plurality of sections secured together by suitable means. The retainer bar 51 has a plurality of longitudinally spaced-apart apertures 53 extending laterally therethrough, while the retainer bar 52 has a plurality of longitudinally spaced-apart apertures 54 extending laterally therethrough. Preferably, the apertures 53 and 54 are oblong with arcuate ends (see FIG. 3) and identical in shape and size, each of the apertures 53 being laterally aligned with a corresponding one of the apertures 54. Fixedly secured to the inner surface of the retainer bar 52 and extending laterally inwardly therefrom along the entire length thereof is a retaining plate 55, which is parallel to and spaced a predetermined distance from the seal plate 24 and cooperates therewith to retain therebetween a sheet or body of asbestos 56 which substantially occupies the gap between the refractory retainer 21 and the retaining bar 52.

Received between the retainer bars 51 and 52 and extending the entire length thereof is a flexible and resilient seal body 57 which projects outwardly a predetermined slight distance beyond the outer ends of the retainer bars 51 and 52, terminating in a sealing surface 58. The seal body 57 is formed of a flexible, resilient, high temperature-resistant material, and may be in the form of a high temperature-resistant core surrounded by a sheath or jacket of wire inserted asbestos, with the wire being of high temperature-resistant alloy, such as that sold under the trademark "Inconel". Preferably, the seal body 57 is secured in place by a plurality of guide pins 59 which extend through aligned ones of the apertures 53 and 54 and through complementary openings in the seal body 57, each of the guide pins 59 having an enlarged circular head 59*a* having a diameter greater than the width of the apertures 53 and 54 to limit the depth of insertion of the pins 59.

Figure 2:
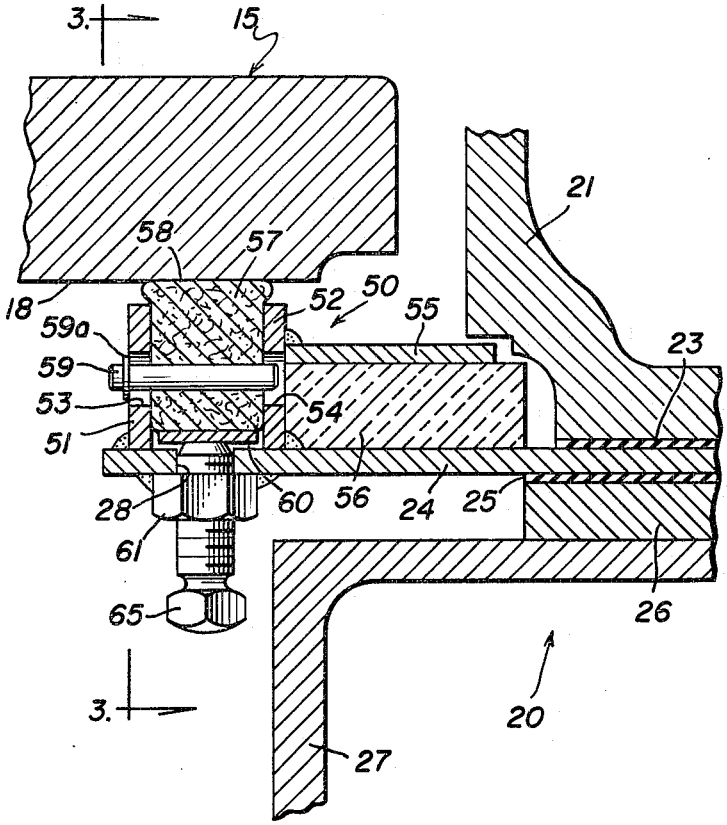
FIG. 2 is an enlarged fragmentary view in horizontal section taken along the line 2—2 in FIG. 1.
Figure 3:
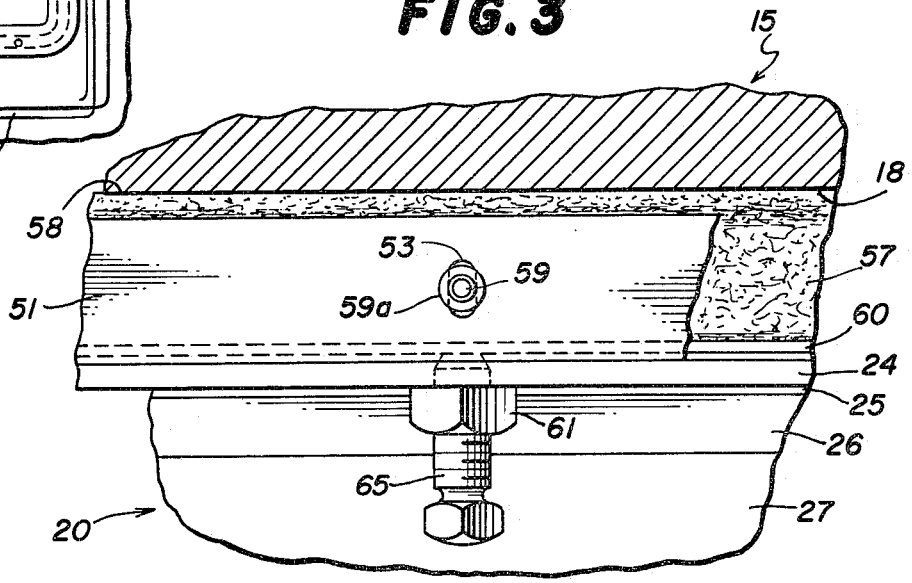
FIG. 3 is a fragmentary view taken along the line 3—3 in FIG. 2.

Disposed between the seal body 57 and the inner surface of the seal plate 24 and between the retaining bars 51 and 52 is a flat rectangular bearing strip 60, which extends around the entire length of the seal body 57 and covers the inner ends of the apertures 28 in the seal plate 24. Fixedly secured to the outer surface of the seal plate 24 as by welding are a plurality of internally threaded nuts 61, equal in number to and respectively axially aligned with the apertures 28. A like plurality of adjusting setscrews 65 are respectively threadedly engaged with the nuts 61 and received through the apertures 28 for engagement with the bearing strip 60 at spaced-apart points therealong for urging the bearing strip 60 into engagement with the seal body 57, as best seen in FIG. 2.

In use, it will be appreciated that when the oven door 20 is disposed in the closed configuration illustrated in the drawings, the sealing surface 58 of the seal body 57 is held in sealing engagement with the sealing surface 18 of the door frame 15, the seal body 57 being deformable to enlarge the area of the sealing surface 58. In practice, the door 20 is first mounted in the closed configuration thereof with all of the setscrews 65 backed off and out of engagement with the bearing strip 60. Any locations around the perimeter of the oven door 20 where the seal between the seal body 57 and the door frame 15 has a gas leak, will be readily apparent to an operator due to the smoky yellowish color of the escaping gas. The operator then simply adjusts the setscrews 65 inwardly in the vicinity of the leak until the smoke ceases, indicating sealing of the leak. It will be appreciated that, as the setscrews 65 are moved inwardly, they push the bearing strip 60 in that region against the seal body 57, thereby increasing the pressure applied to the seal body 57, which pressure is resisted by the sealing surface 18 on the door frame 15, causing the seal body 57 to deform against the sealing surface 18 to improve the gas seal. Once the door has been thus properly adjusted to seal all leaks, it may be removed and refitted numerous times without further adjustment.

In a constructional model of the invention, the bearing strip 60 is formed of steel, and the adjusting setscrews 65 are spaced at intervals of about six to twelve inches around the perimeter of the door 20. While the seal body 57 is preferably of the type described above, it will be appreciated that any other suitable flexible, resilient and high temperature-resistant material could be used. It will also be appreciated that the seal body 57 could be retained in place by means other than the guide pins 59 or, indeed, it may be that fastening means may not be necessary in certain applications.

From the foregoing, it can be seen that there has been provided an improved door seal assembly for a coke oven, which door seal assembly comprises a flexible high temperature-resistant seal body and means for adjusting the pressure with which the seal body engages a complementary sealing surface on the associated door frame. By this invention, local irregularities in the sealing surfaces of the door frame or the oven door, caused by warping or the like, can readily be compensated for.

While there has been described what is at present considered to be the preferred embodiment of the invention, it will be understood that various modifications may be made therein, and it is intended to cover in the appended claims all such modifications as fall within the true spirit and scope of the invention.

What is claimed is:

1. In a coke oven having a door opening with a first surface extending around the periphery thereof and a door with a second surface extending around the periphery thereof and disposable in a closed configuration for closing the door opening, a door seal assembly comprising two spaced-apart retaining members mounted on one of said first and second surfaces and extending outwardly therefrom and cooperating therewith to define a channel, said retaining members being respectively provided with longitudinally spaced-apart pairs of laterally aligned openings therethrough, a resilient heat-resistant seal body secured in said channel between said retaining members and extending outwardly therebeyond for sealing engagement with the other of said first and second surfaces around the entire periphery thereof when the door is disposed in the closed configuration thereof, attachment pins respectively extending through said pairs of aligned openings and through said seal body for securing said seal body in said channel, continuous bearing means disposed in said channel between said seal body and said one of said first and second surfaces and extending substantially around the entire periphery thereof, and control means adjustably mounted for engagement with said bearing means to urge it throughout its length into engagement with said seal body with a variable pressure, whereby adjustment of said control means effects a corresponding adjustment of the pressure with which said seal body engages the other one of said first and second surfaces when the door is disposed in the closed configuration thereof.

2. The door seal assembly set forth in claim 1, wherein said door seal assembly is mounted on said second surface.

3. The door seal assembly set forth in claim 1, wherein said bearing means comprises a flat steel strip disposed substantially parallel to said one of said first and second surfaces.

4. The door seal assembly set forth in claim 1, wherein said seal body comprises a core of high temperature-resistant material covered with a sheath of high temperature-resistant metal and asbestos.

5. The door seal assembly set forth in claim 1, wherein said retaining members are disposed substantially parallel to each other and substantially perpendicular to said one of said first and second surfaces.

6. In a coke oven having a door opening with a sealing surface extending around the periphery thereof and a door with a mounting member having a mounting surface extending around the periphery thereof and disposable in a closed configuration for closing the door opening, a door seal assembly comprising two spaced-apart retaining members mounted on said mounting surface and extending outwardly therefrom for cooperation therewith to define a channel, said mounting surface having a plurality of longitudinally spaced-apart apertures therethrough between said retaining members, said retaining members being respectively provided with longitudinally spaced-apart pairs of laterally aligned openings therethrough, a resilient heat-resistant seal body secured in said channel between said retaining members and extending outwardly therebetween for sealing engagement with said sealing surface when the door is disposed in the closed configuration thereof, attachment pins respectively extending through said pairs of aligned openings and through said seal body for securing said seal body in said channel, continuous bearing means disposed in said channel between said seal body and said mounting surface and extending substantially around the entire periphery thereof, and a plurality of setscrews threadedly mounted on said mounting member and axially receivable through said apertures for engagement with said bearing means to urge it throughout its length into engagement with said seal body with a variable pressure, whereby adjustment of said setscrews effects a corresponding adjustment of the pressure with which said seal body engages said sealing surface when the door is disposed in the closed condiguration thereof.

7. The door seal assembly set forth in claim 6, and further including a plurality of attachment members fixedly secured to said mounting member and having internally threaded openings therethrough respectively axially aligned with said apertures, said setscrews being respectively threadedly engaged in said attachment members.

* * * * *